US007712406B2

(12) United States Patent
Reimers

(10) Patent No.: US 7,712,406 B2
(45) Date of Patent: May 11, 2010

(54) METHOD AND DEVICE FOR ACTIVATION OF A DETONATOR

(75) Inventor: Nils Reimers, Bjoa (NO)

(73) Assignee: Total Catcher Offshore AS, Bergen (NO)

( * ) Notice: Subject to any disclaimer, the term of this patent is extended or adjusted under 35 U.S.C. 154(b) by 630 days.

(21) Appl. No.: 10/536,758

(22) PCT Filed: Nov. 20, 2003

(86) PCT No.: PCT/NO03/00390

§ 371 (c)(1),
(2), (4) Date: Oct. 6, 2005

(87) PCT Pub. No.: WO2004/104512

PCT Pub. Date: Dec. 2, 2004

(65) Prior Publication Data

US 2006/0180013 A1 Aug. 17, 2006

(30) Foreign Application Priority Data

Nov. 20, 2002 (NO) ..... 2002 5559

(51) Int. Cl.
*F41F 5/00* (2006.01)
*F42C 5/00* (2006.01)
*F42D 3/00* (2006.01)

(52) U.S. Cl. ..... 89/1.15; 175/4.54

(58) Field of Classification Search ..... 89/1.15; 166/55–58.3, 63, 297; 175/2–4.6; 102/313
See application file for complete search history.

(56) References Cited

U.S. PATENT DOCUMENTS 2,227,198 A * 12/1940 Piggot ..... 175/6
4,560,000 A * 12/1985 Upchurch ..... 166/55.1
4,762,179 A * 8/1988 Wesson et al. ..... 166/297
4,862,964 A 9/1989 George et al.
4,886,127 A 12/1989 Ricles et al.
5,040,463 A * 8/1991 Beaverson ..... 102/210
5,215,148 A * 6/1993 Ricles ..... 166/298
5,540,293 A * 7/1996 Mohaupt ..... 175/3.5
5,603,384 A * 2/1997 Bethel et al. ..... 175/4.54
5,632,348 A 5/1997 Yunan
5,680,905 A * 10/1997 Green et al. ..... 175/4.54
5,911,277 A * 6/1999 Hromas et al. ..... 166/297

(Continued)

FOREIGN PATENT DOCUMENTS

WO 322.871 11/2002

*Primary Examiner*—Troy Chambers
(74) *Attorney, Agent, or Firm*—Stites & Harbison, PLLC; Juan Carlos A. Marquez, Esq.

(57) ABSTRACT

A method is described for detonation of a blasting charge in a fluid environment and which is placed inside a hollow body, such as in an ignition pellet. The method is characterised in that an ignition pellet is used, which is arranged to be deformed under the influence of a number of alterations or pulsations between high and low pressure in the surrounding fluid environment, with the detonation triggering unit inside the body being activated at the subsequent contact with the fluid environment as a consequence of the pellet being deformed. In rupturing, external fluid at overpressure is released into the cylinder and drives a firing pin against a detonating cartridge. A device for an ignition pellet is also described.

6 Claims, 2 Drawing Sheets

U.S. PATENT DOCUMENTS 6,213,203 B1 * 4/2001 Edwards et al. ..... 166/55.1
2003/0056953 A1 * 3/2003 Tumlin et al. ..... 166/298
2004/0118562 A1 6/2004 George
2006/0180013 A1 8/2006 Reimers

* cited by examiner

METHOD AND DEVICE FOR ACTIVATION OF A DETONATOR

The present invention relates to a method and a device for detonation of a blasting charge in a fluid environment, and where the blasting charge is positioned inside a hollow body, such as in an ignition pellet, as will appear from the preamble to the following claim 1. Further, the invention also relates to an application.

More precisely the invention relates to an ignition device of an ignition mechanism which is applied together with explosives in liquid-filled pipes and well holes. It is arranged for remote operation for detonating of explosives, for example in order to perforate a pipe wall or to perforate or remove plugs in oil and gas wells. The production from the reservoir may then commence.

For different appliances, triggering explosive charges is previously known, and is based on release by mechanical means or by using an electrical primer with a cable connection.

Remote controlled ignition pellets, which are based on the use of pressure increases via a liquid inside a pipe or a well bore are known from U.S. Pat. Nos. 5,680,905, 5,632,348 and 4,886,127. A rupture disc or the like inside the pipe is made to break so that the pressure may exert a force onto a firing pin which in turn is moved to initiate the detonation of a detonating cartridge inside the pellet.

It is an object of the invention to provide a completely new method to bring about the detonation of such ignition pellets/mechanisms as a further development of the previously known solutions.

It is a further object of the invention to provide a completely new structure of such an ignition pellet, so that it may be remotely operated by means of the new triggering mechanism.

Compared with the state of the art, the ignition charge (blasting charge) may be triggered to detonate by means of a sequence of pressure oscillations, which can be exerted from the liquid inside the pipe or in the well from the exit side, such as from the surface.

According to the invention the ignition pellet is used for perforating a pipe wall or for perforating or removing plugs in oil and gas wells, thus, for example, for starting the production from a reservoir through a pipe.

The feature distinguishing the present invention from previously known technology, is its unique way of functioning which, without affecting the reliability, makes it possible to be made from materials which evaporate or dissolve due to the detonation pressure, so that the production of liquid/crude oil through the pipe may start directly. According to the invention, these properties can be obtained by the ignition pellet or the ignition mechanism being structured as a cylinder comprising a completely leak proof low pressure chamber. In a well-known manner, a pressure operated firing pin is arranged inside the low pressure chamber, associated with an ignition cartridge. In the solid material of the cylinder one or more scores, grooves or recesses are made, which create a plurality of deformation or attenuating areas of the solid material of the cylinder. The ignition cylinder is positioned, such as by its end section, in relation to the object (for example a glass plug) to which the detonation pellet shall exert its detonation force.

The other end of the cylinder can be kept in tension by means of a spring, which will counteract that external pressure will compress the cylinder by way of destruction of the attenuating areas of the solid material of the cylinder, something that may cause the detonation charge to explode unintentionally. When an outer/external increasing fluid pressure is exerted on the cylinder, this will be axially compressed and deformed in the recesses/attenuating areas when the axial force exceeds the stiffness of the solid material of the cylinder and the tension of the spring.

When the pressure is released/eased, the cylinder, helped by the spring, will return to it original length. Thereby, a crack will immediately penetrate inwards in the cylinder, in connection to the deformed crack initiation or score in the solid material as a consequence of the material fatigue or the attenuation of the solid material of the cylinder. After a number of pressure swings, the crack will finally reach through the solid wall material of the cylinder so that the external fluid pressure penetrates into the cylinder and will then drive the firing pin which is originally held in place with the help of a shear pin or the like, into the detonation cartridge/blasting charge which then will detonate. The metal in the cylinder will consequently reach its yield point and a high pressure will thereby contribute to the deformation. The spring, which is fastened on the outside of the cylinder, ensures that the cylinder is stretched out again when the pressure is eased. Such forward and back movements will thereby reinforce a fatigue rupture in the attenuated area.

Alternatively, the mentioned spring can be fitted internally at the one end of the cylinder. The spring is then better protected. Besides, the spring shall only contribute by creating such movements in the solid material of the cylinder so that fatigue of the solid material is achieved.

This simple construction and mode of action permits the use of materials with low evaporation and combustion temperatures so that after detonation, a minimum of components from the ignition device and its mechanism remain. The ignition pellet is made from a metal, preferably aluminium or zinc, or alloys of these.

The invention shall now be explained further in connection with the following figures, in which.

Figure 1:
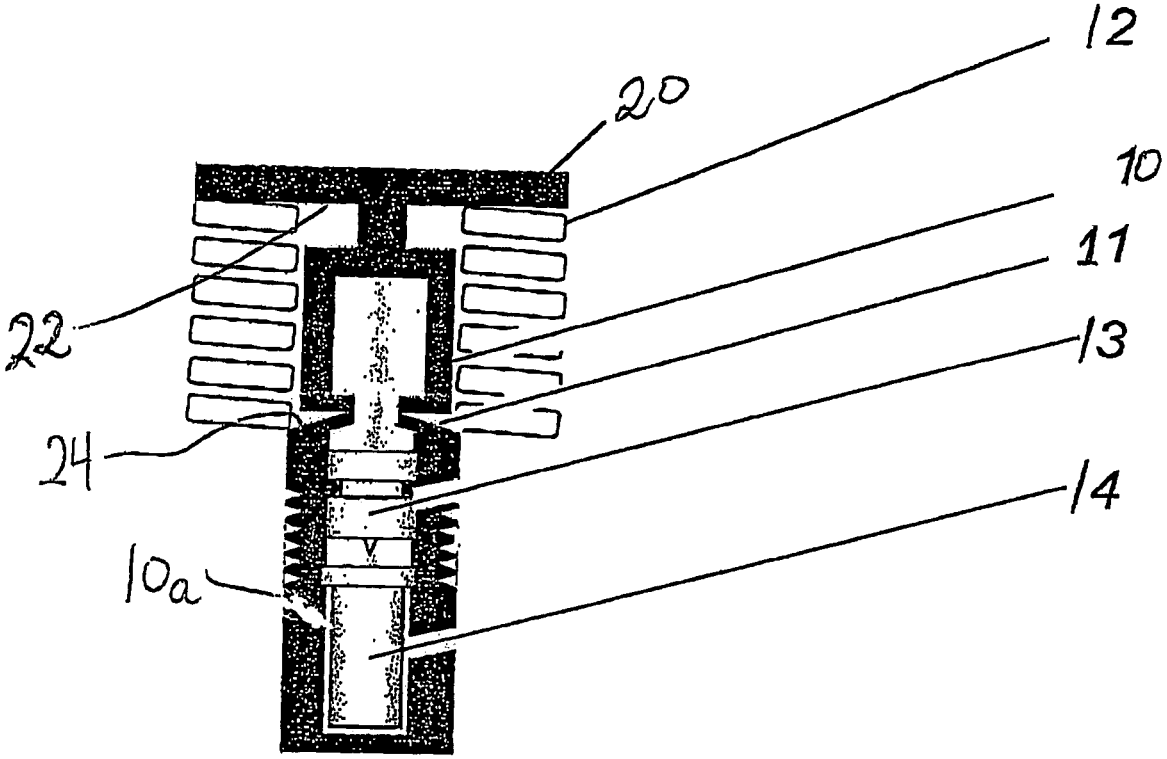
FIG. 1 shows an ignition pellet according to the invention with an internal chamber, a firing pin and a detonation cartridge/blasting charge.

The pellet/cylinder is shown in FIG. 1 with the reference number 10. The pellet 10 comprises an internal drilled hole or hollow space 10*a* in which the ignition mechanism itself is placed, equipped with a firing pin 13 and a blasting charge 14, with the blasting charge 14 positioned at the bottom of the drilled hole in the one end of the cylinder. There is atmospheric pressure or an under-pressure of gas/air in the hollow space 10*a*. This will result in the pressure variations, as a consequence of movements of the cylinder wall, being absorbed and not becoming sufficient to move the firing pin so that the blasting charge is detonated.

The firing pin 13 can be suspended inside the hollow space with a shear pin, or the like. When the ignition pellet ruptures, the high pressure contributes to push the firing pin in towards the lower pressure around the blasting charge. The lower spike 30 of the firing pin 13 penetrates into the blasting charge and triggers the detonation. The ignition pellet is made from a metal, preferably aluminium or zinc, of alloys thereof, or from corresponding metals. This end of the pellet 10 that encompasses the blasting charge is positioned adjoining the object, such as a glass plug 17, which the blasting charge is to act against.

The other end of the pellet 10 comprises an enlarged, circular, flange-like section 20 which forms a hook 22. In the cylindrical pellet body, a score, indentation or crack initiation 11 is cut in the solid material of the cylinder wall. A spring 12 is fastened with an appropriate initial tension between the underside of the hook 22 and an upwardly turning edge 24 on the outer cylinder wall which is formed by the indentation 11. The spring will thereby counteract an eventual axial compression of the pellet/cylinder 10 caused by an external overpressure.

According to the invention, a number of mutually separated scores or indentations can be cut in the solid pellet material around the pellet circumference, but it has been found that two such cut scores which are mutually spaced apart result in good deformation characteristics for the pellet.

According to the invention, when the solid wall material has a thickness of about 4-5 mm, an attenuation groove or furrow in the solid material can be 2-3 mm deep and with a V-shaped cross section as shown in the figure. But one shall not be limited to this.

According to an alternative solution for the ignition device according to the invention, the detonation can be started when the blasting charge comes into contact with liquid that flows in through the opening in the cylinder when the solid material of the pellet wall is ruptured.

The indentation 11 is thereby lying between the two mounting points on the spring 12 on the cylinder. With pulsating alternations between high and low pressure, the metal in the cylinder will reach its yield point and the metal will alternatively be compressed by the counter-effect of the spring 12 and stretched (bending/compressing/stretching) by the co-operating effect of the spring, respectively. Finally, when the solid metal material reaches its yield point at the indentation, a deformation of the cylinder wall arises. Thereby, the high pressure gets access to the hollow space in the cylinder and the firing pin breaks the shear pin and is pushed into the low-pressure chamber and makes contact with the blasting charge. Such high temperatures arise during the blasting that the metal (aluminium/zinc) evaporates.

Figure 2:
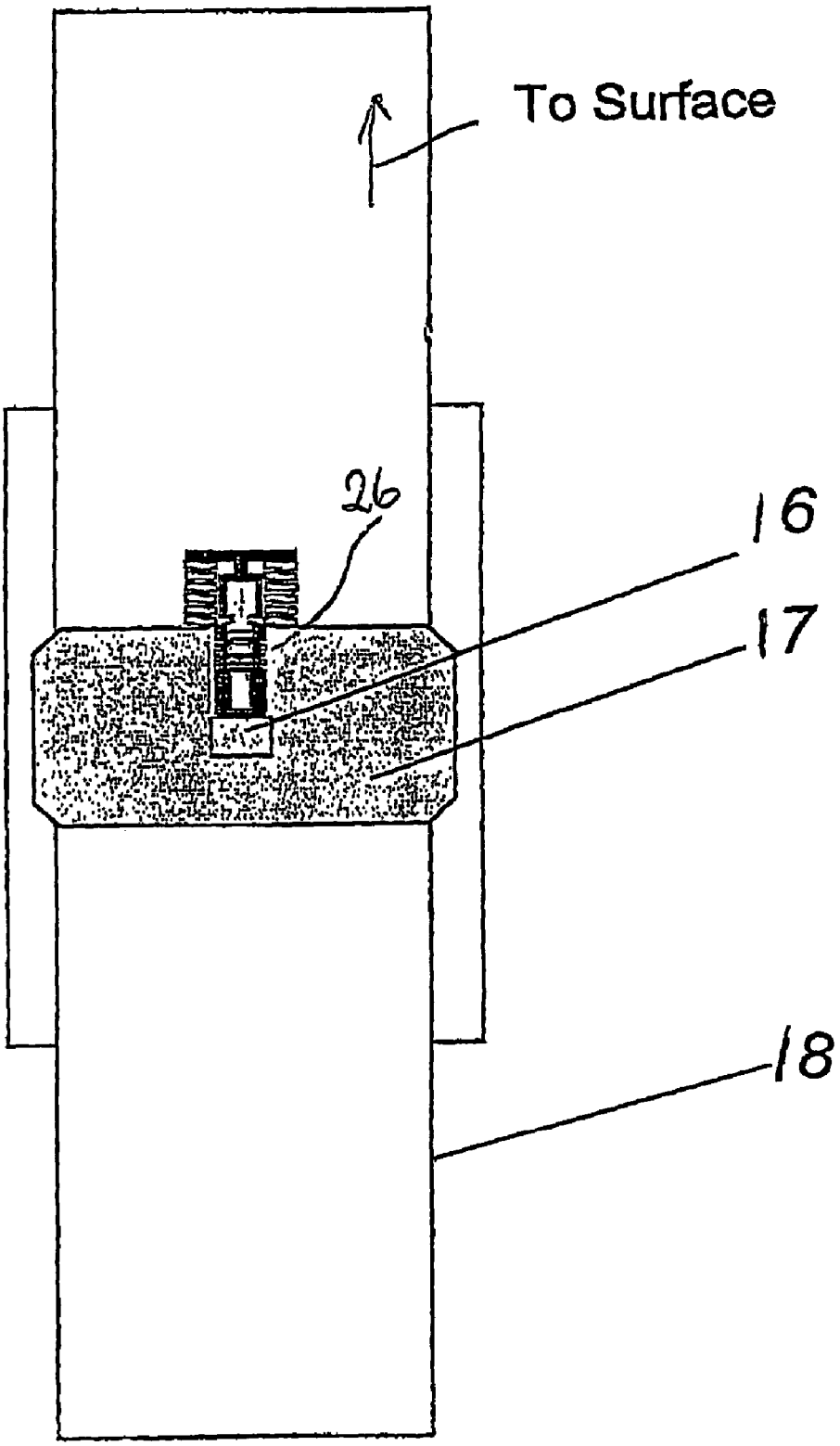
FIG. 2 shows a plug, such as a glass plug, which is fitted for pressure testing of a pipe where the ignition pellet in the device according to the invention has an object to detonate an explosive charge and pulverise the plug when the test is completed.

FIG. 2 shows a plug 17, such as a plug made of glass, which sits in a pipe 18 as a soluble or removable seal against flow of fluid through the pipe for carrying out tests. The cylindrical ignition device 10 according to the invention is placed down in a hole 26 in the plug 17 with the explosive blasting charge 14 lying against the plug surface in the bottom of the hollow/hole.

When the plug has carried out its function and shall be removed, pressure variations are applied through the fluid, which fills the pipe or bore hole, such that the pressure variations exert a variable pressure/force on the ignition pellet so that a fatigue/fatigue fracture arises which in turn opens the pellet and sets off the blasting charge.

The pressure tight cylinder is filled with a gas with atmospheric pressure or lower pressure so that the pressure variations as a consequence of the movements in the cylinder wall itself are absorbed and not sufficient to drive the firing pin and start the detonation.

The invention claimed is:

1. A method for detonation of a blasting charge, wherein the blasting charge is in a fluid environment, and is placed inside a hollow body, and wherein the hollow body is arranged so as to be deformed under influence of a number of alternating or pulsating high and low pressures of the fluid environment, and a detonation triggering unit inside the hollow body is activated under subsequent contact with the fluid environment as a consequence of the hollow body being deformed, wherein pellet metal in the hollow body is compressed and stretched repeatedly by a counter-effect and co-operating effect of a spring in connection to the hollow body so as to bring about a fatigue fracture in a solid metal material of the hollow body and open for access to the detonation triggering unit.

2. The method according to claim 1, wherein the detonation triggering unit comprises a firing pin which is brought to abut the blasting charge and explode the blasting charge under influence of an overpressure from the fluid environment.

3. The method according to claim 1, wherein the blasting charge is triggered when the blasting charge comes into contact with a liquid from the fluid environment.

4. The method according to claim 1, wherein deformation resulting from pressure pulses is concentrated to an area of the hollow body so that a groove is cut into a solid metal material and a gradually larger crack through the solid material of the wall is provided in the area, and finally gives the fluid access to a hollow space of the hollow body.

5. The method according to claim 1, wherein the hollow body is made of metal, such as aluminium, or copper, or alloys thereof.

6. The method according to claim 1, wherein the hollow body is an ignition pellet.

* * * * *